US007588502B2

(12) United States Patent
Nishino

(10) Patent No.: US 7,588,502 B2
(45) Date of Patent: Sep. 15, 2009

(54) GOLF CLUB HEAD

(75) Inventor: Takumi Nishino, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 65 days.

(21) Appl. No.: 11/607,866

(22) Filed: Dec. 4, 2006

(65) Prior Publication Data

US 2007/0149316 A1 Jun. 28, 2007

(30) Foreign Application Priority Data

Dec. 26, 2005 (JP) ..... 2005-372659

(51) Int. Cl.
*A63B 53/04* (2006.01)
*A63B 53/06* (2006.01)

(52) U.S. Cl. ..... 473/332; 473/337; 473/350

(58) Field of Classification Search ..... 473/324–350
See application file for complete search history.

(56) References Cited

U.S. PATENT DOCUMENTS

| | | | | |
|---|---|---|---|---|
| 4,687,205 | A * | 8/1987 | Tominaga et al. | 473/348 |
| 4,867,458 | A * | 9/1989 | Sumikawa et al. | 473/336 |
| 4,869,507 | A * | 9/1989 | Sahm | 473/337 |
| 5,314,180 | A * | 5/1994 | Yamagishi et al. | 473/521 |
| 5,316,305 | A * | 5/1994 | McCabe | 473/332 |
| 5,385,348 | A * | 1/1995 | Wargo | 473/338 |
| 5,697,855 | A | 12/1997 | Aizawa | |
| 5,807,191 | A * | 9/1998 | Nakahara | 473/350 |
| 5,947,840 | A * | 9/1999 | Ryan | 473/335 |
| 6,012,990 | A | 1/2000 | Nishizawa | |
| 6,179,726 | B1 * | 1/2001 | Satoh et al. | 473/290 |
| 6,290,609 | B1 * | 9/2001 | Takeda | 473/335 |
| 6,344,000 | B1 * | 2/2002 | Hamada et al. | 473/329 |
| 6,344,001 | B1 * | 2/2002 | Hamada et al. | 473/329 |
| 6,368,232 | B1 * | 4/2002 | Hamada et al. | 473/329 |
| 6,406,382 | B1 * | 6/2002 | Deshmukh et al. | 473/349 |
| 6,530,846 | B1 * | 3/2003 | Mase | 473/290 |
| 6,592,468 | B2 * | 7/2003 | Vincent et al. | 473/334 |
| 6,616,547 | B2 * | 9/2003 | Vincent et al. | 473/334 |
| 6,679,784 | B2 * | 1/2004 | Mase | 473/290 |
| 6,688,989 | B2 * | 2/2004 | Best | 473/332 |
| 6,743,114 | B2 * | 6/2004 | Best | 473/291 |
| 6,811,496 | B2 * | 11/2004 | Wahl et al. | 473/334 |
| 6,835,144 | B2 * | 12/2004 | Best | 473/332 |
| 6,855,066 | B2 * | 2/2005 | Best | 473/291 |
| 6,962,538 | B2 * | 11/2005 | Roach et al. | 473/332 |

(Continued)

FOREIGN PATENT DOCUMENTS

| | | |
|---|---|---|
| JP | 9-322952 A | 12/1997 |

(Continued)

*Primary Examiner*—Alvin A Hunter
(74) *Attorney, Agent, or Firm*—Birch, Stewart, Kolasch & Birch, LLP

(57) ABSTRACT

A golf club head comprises a main body provided with at least two holes and detachable parts attached to said holes, the detachable parts including a weight member and a damper, the weight member having a specific gravity larger than the main body, the damper having a specific gravity different from the weight member and made of elastic material at least partially for absorbing a vibration of the main body, and the damper and the weight member being attached to the holes of the main body so that each position can be exchanged.

16 Claims, 9 Drawing Sheets

U.S. PATENT DOCUMENTS

| | | | | |
|---|---|---|---|---|
| 7,025,695 | B2 * | 4/2006 | Mitsuba | 473/349 |
| 7,077,763 | B2 * | 7/2006 | Wahl et al. | 473/334 |
| 7,121,956 | B2 * | 10/2006 | Lo | 473/335 |
| 7,153,220 | B2 * | 12/2006 | Lo | 473/335 |
| 7,192,362 | B2 * | 3/2007 | Gilbert et al. | 473/291 |
| 7,273,423 | B2 * | 9/2007 | Imamoto | 473/332 |
| 7,294,065 | B2 * | 11/2007 | Liang et al. | 473/335 |
| 7,354,355 | B2 * | 4/2008 | Tavares et al. | 473/329 |
| 2002/0068645 | A1 * | 6/2002 | Vincent et al. | 473/338 |
| 2003/0013545 | A1 * | 1/2003 | Vincent et al. | 473/332 |
| 2003/0092499 | A1 * | 5/2003 | Gilbert | 473/291 |
| 2003/0199331 | A1 * | 10/2003 | Stites, III | 473/290 |
| 2003/0203763 | A1 * | 10/2003 | Best | 473/290 |
| 2003/0203768 | A1 * | 10/2003 | Best | 473/345 |
| 2004/0043830 | A1 * | 3/2004 | Imamoto | 473/332 |
| 2004/0176178 | A1 * | 9/2004 | Best | 473/290 |
| 2005/0148405 | A1 * | 7/2005 | Imamoto | 473/338 |
| 2006/0100029 | A1 * | 5/2006 | Lo | 473/338 |
| 2007/0015600 | A1 * | 1/2007 | Breier et al. | 473/334 |
| 2007/0105646 | A1 * | 5/2007 | Beach et al. | 473/329 |
| 2007/0105649 | A1 * | 5/2007 | Beach et al. | 473/334 |
| 2007/0149316 | A1 * | 6/2007 | Nishino | 473/335 |
| 2008/0009366 | A1 * | 1/2008 | Lo | 473/335 |

FOREIGN PATENT DOCUMENTS

| | | |
|---|---|---|
| JP | 2003-47678 A | 2/2003 |

* cited by examiner

GOLF CLUB HEAD

BACKGROUND OF THE INVENTION

1. Field of the Invention

The present invention relates to a golf club head which can increase a degree of freedom for designing a center of gravity and improve a ball hitting feeling.

2. Description of the Related Art

There has been conventionally proposed various golf club heads in which a weight member having a great specific gravity is attached to a head main body. In the club heads, a position of the center of gravity is optimized, however, it is hard to change the position of the center of gravity of the head on the basis of a skill of each golfer.

Further, in order to absorb an impact force at a time of hitting a ball, there has been proposed a golf club head in which an elastic member is adhered to a back side of a face portion. In the club mentioned above, the elastic member tends to break away in accordance with the use.

SUMMARY OF THE INVENTION

The present invention is made by taking the actual condition mentioned above into consideration, and a main object of the present invention is to provide a golf club head in which a position of a center of gravity of the club head can be independently adjusted, for example, by a user, and which has an excellent ball hitting feeling.

According to the present invention, a golf club head comprises a main body provided with at least two holes and detachable parts-attached to said holes, the detachable parts including a weight member and a damper, the weight member having a specific gravity larger than the main body, the damper having a specific gravity different from the weight member and made of elastic material at least partially for absorbing a vibration of the main body, and the damper and the weight member being attached to the holes of the main body so that each position can be exchanged.

The center of gravity of the weight member and the damper is less than 15.0 mm from the horizontal plane while the club head is in a standard condition where the golf club head is placed on a horizontal plane at its lie and loft angles.

DESCRIPTION OF THE PREFERRED EMBODIMENTS

Embodiments of the present invention will now be described in detail in conjunction with the accompanying drawings.

Figure 2:
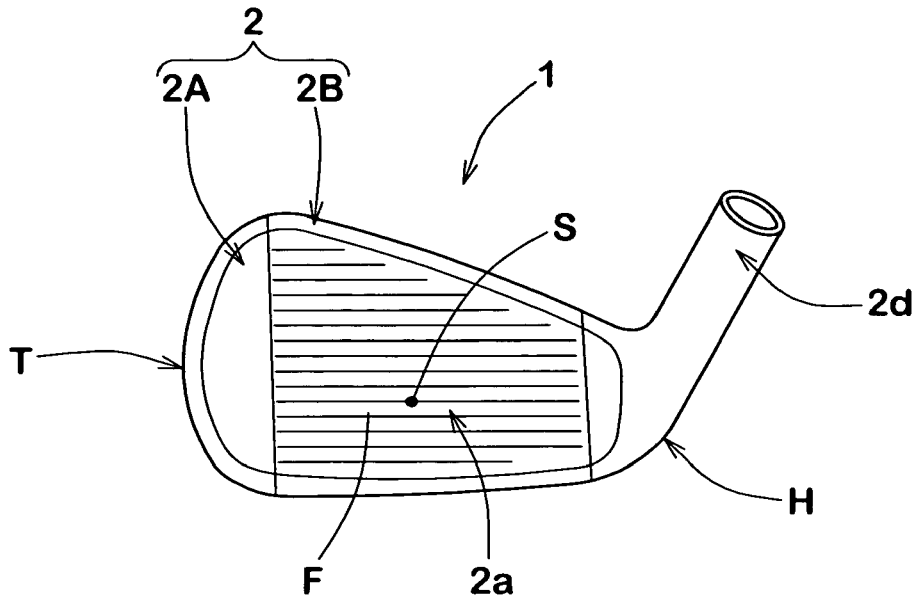
FIG. 2 is a front elevational view of FIG. 1.
Figure 3:
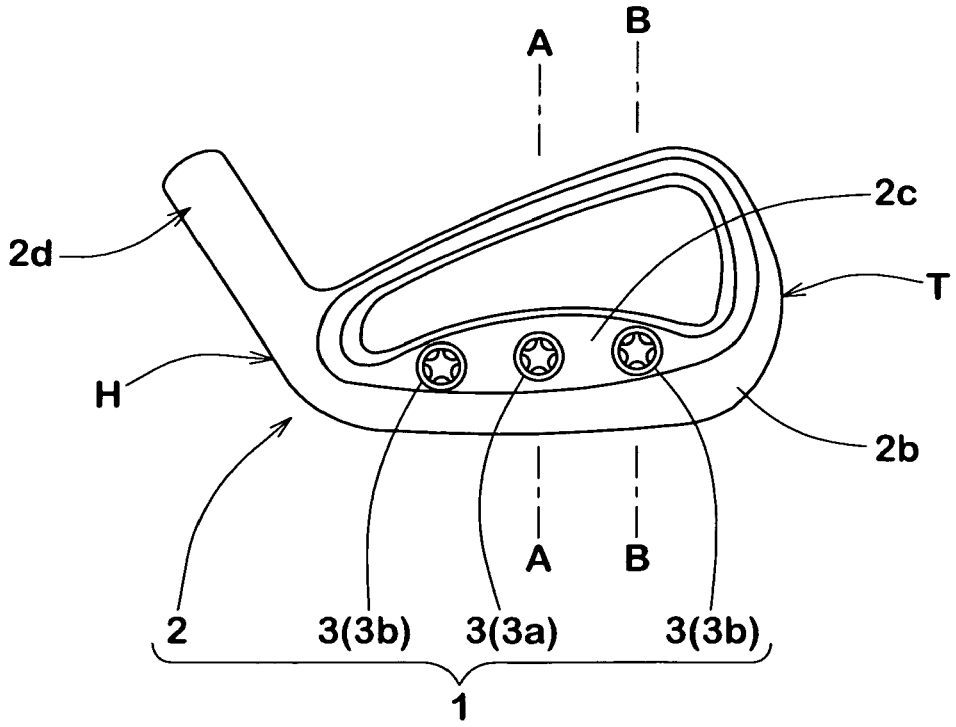
FIG. 3 is a back elevational view of FIG. 2.
Figure 4:
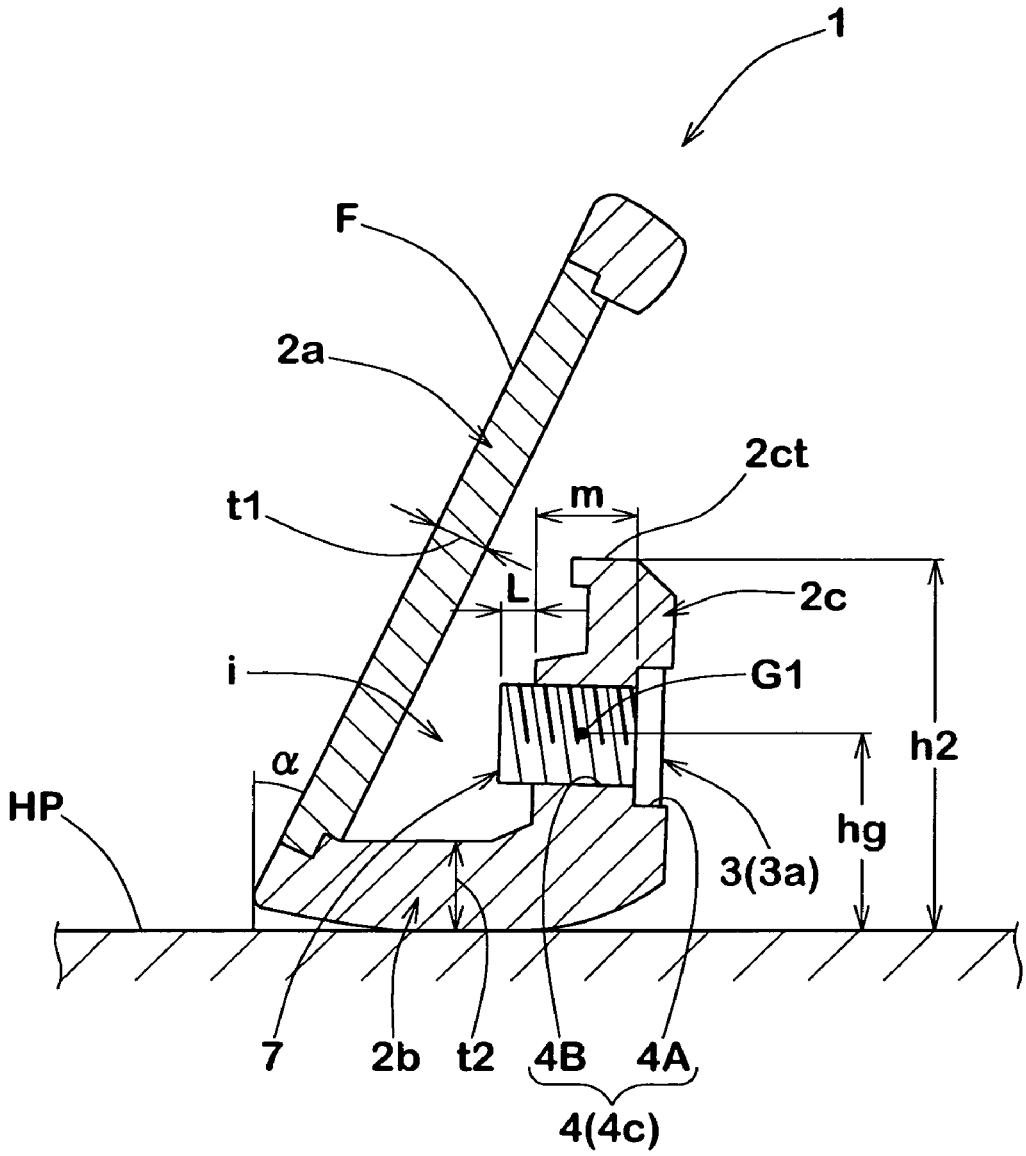
FIG. 4 is a cross sectional view along a line A-A in FIG. 3.
Figure 5:
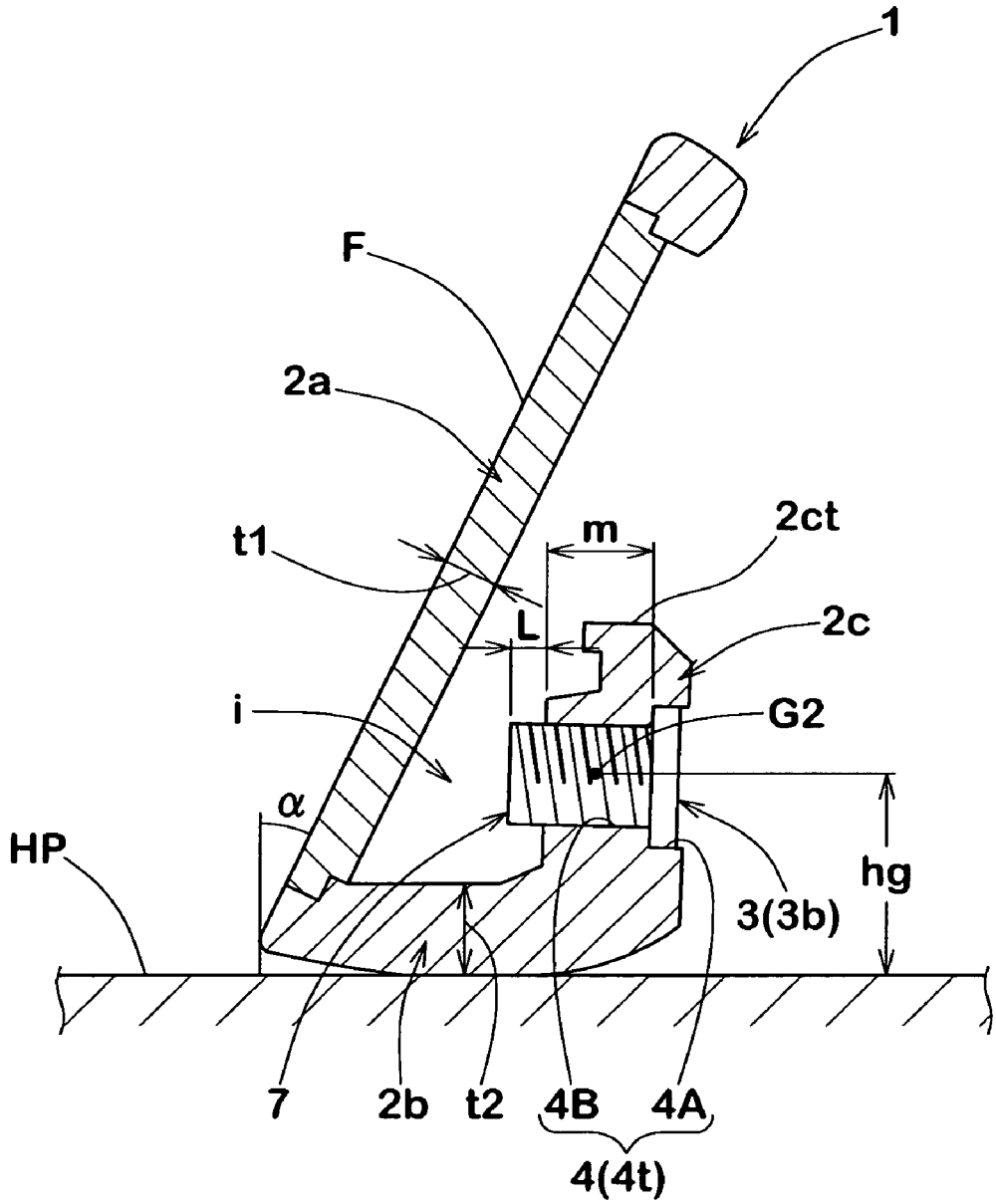
FIG. 5 is a cross sectional view along a line B-B in FIG. 3.

FIGS. 4 and 5 show a standard condition of a golf club head 1 (which may be, hereinafter, referred to simply as "head" or "club head"). The standard condition is a condition in which the club head 1 is placed on a horizontal plane HP with its lie angle and loft angle $\alpha$. Further, FIGS. 2 and 3 show the club head 1 in a condition of being inclined such that a club face F becomes perpendicular from the standard condition.

The golf club head 1 in accordance with the present embodiment comprises a head main body 2 provided with three holes 4, and three detachable parts 3 installed to the holes 4 of the head main body 2 detachably.

In the present embodiment, the head main body 2 is structured as an iron type which includes a face portion 2*a* having a club face F for hitting a ball, a sole portion 2*b* extending from a lower edge of the club face F toward a back face, a turnup wall 2*c* turned up at a rear side of the sole portion 2*b* so as to form a gap "i" behind the face portion 2*a*, and a hosel portion 2*d* provided diagonally upward in a heel H side and to which a shaft (not shown) is installed.

The head main body 2 is preferably formed by a metal material. As the metal material, for example, a stainless steel (specific gravity 7.8), a titanium alloy (specific gravity 4.5), an aluminum alloy (specific gravity 2.7), a soft iron (specific gravity 7.9), a magnesium (specific gravity 1.8) and the like are employed. Above all, the stainless steel, the titanium alloy or the soft iron is desirable. Further, in order to achieve a weight saving of the head main body 2, for example, a carbon fiber reinforced resin (specific gravity 1.4) or the like may be employed partly. In this case, each of the specific gravities mentioned above is shown as a typical value.

In order to secure a good swing balance with suitable size of the head, the specific gravity $\rho m$ of the head main body 2 is preferably not less than 2.0, more preferably not less than 3.0, and further preferably not less than 4.0. Further, an upper limit of the specific gravity $\rho m$ is preferably not more than 10.0, more preferably not more than 9.0, and further preferably not more than 8.0. Here, in the case that the head main body 2 is not constituted by a single material, the specific gravity mentioned above employs an average specific gravity weighted by a volume of each of the materials constituting the head main body 2.

The head main body 2 in accordance with the present embodiment is constituted by a face plate 2A made of a titanium alloy and forming a main portion of the face portion 2*a*, and a receiving frame 2B made of a stainless steel and having a front surface to which the face plate 2A is attached. Further, the receiving frame 2B is provided with the sole portion 2*b* and the turnup wall 2*c*. In the head main body 2 mentioned above, since a weight of the head is distributed much in a peripheral portion of the face surface F, a sweet area is increased, and it is possible to improve a directionality of the hit ball. In this case, both the face plate 2A and receiving flame 2B are firmly attached, for example, by using an adhesion, a so-called "caulking" utilizing a plastic deformation, a pressure insertion utilizing an elastic deformation, a screwing, a welding or two or more joint means. The head main body 2, however, may be structured by a single material.

Figure 11A:
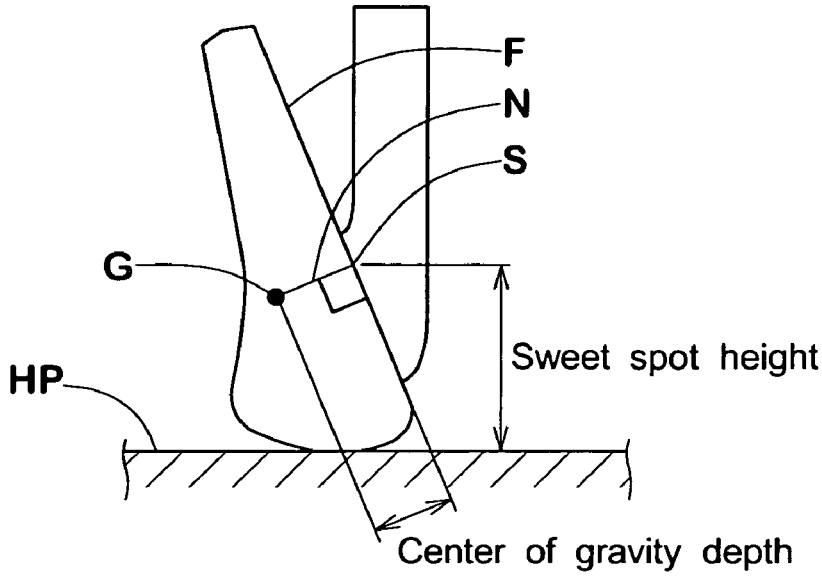
FIG. 11(A) is a side elevational view of a standard condition of an iron type club head.

It is desirable that the face portion 2*a* has sufficient durability and repulsion performance (a performance of increasing a carry by bending suitably at a time of hitting the ball) with respect to a repeated ball hitting. From this point of view, it is desirable that a thickness t1 at the sweet spot S of the face portion 2*a* is, for example, not less than 2.0 mm, and more preferably not less than 2.5 mm, and it is desirable that an upper limit thereof is preferably not more than 4.0 mm, and more preferably not more than 3.5 mm. In this case, the sweet spot S is set to a nodal point between a normal line N perpendicularly drawn from a center of gravity G of the club head to the club face F and the club face F, as shown in FIG. 11A.

As shown in FIG. 4, the sole portion 2*b* in accordance with the present embodiment is exemplified by a structure in which a thickness t2 measured in a perpendicular direction is gradually increased toward a rear side of the head. As mentioned above, it is possible to position the center of gravity of the club head to a rear side of the head by gradually increasing the thickness t2 of the sole portion 2*b* toward the rear side of the head. Accordingly, it is possible to enlarge a center of gravity depth and to improve the directionality of the hit ball.

Figure 1:
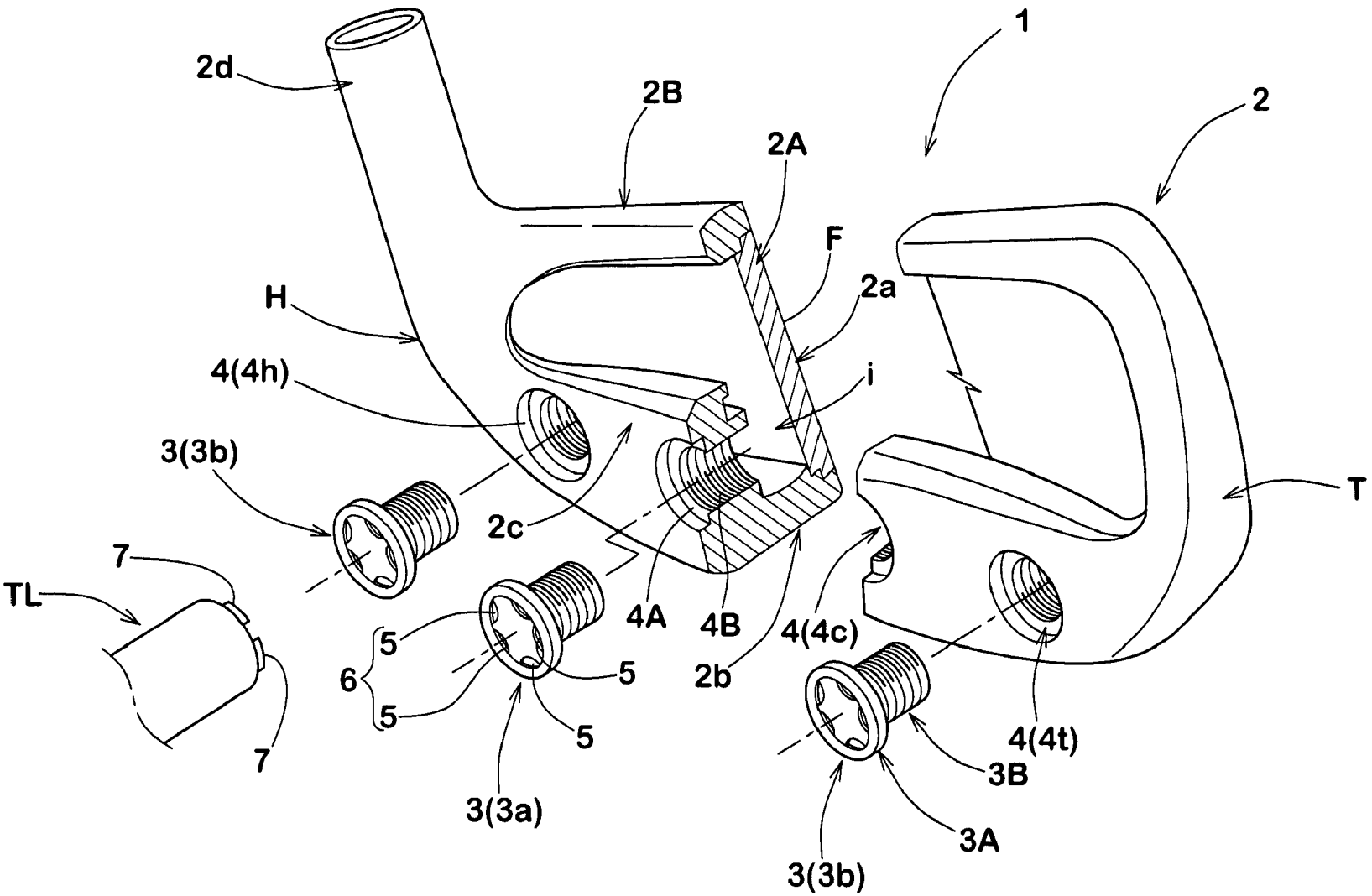
FIG. 1 is an exploded perspective view of an iron type club head showing the present embodiment.

The turnup wall 2*c* extends approximately perpendicularly toward an upper side at a rear end of the sole portion 2*b*, as shown in FIGS. 1, 4 and 5. In the present embodiment, an upper end 2*ct* of the turnup wall 2*c* is terminated without being in contact with the back surface of the face portion 2*a*. The turnup wall 2*c* mentioned above efficiently allocate more weight to a rear side and a bottom side of the head. In order to sufficiently achieve the effect, it is desirable that a height h2 from the horizontal plane HP to the upper end 2*ct* of the turnup wall 2*c* is preferably not less than 30% of a maximum height of the club head in the standard condition, and more preferably not less than 35%, and an upper limit thereof is preferably not more than 65%, and more preferably not more than 60%.

Further, the gap i is formed between the turnup wall 2*c* and the face portion 2*a*. Further, the gap i is formed as a so-called pocket-cavity extending in a toe and heel direction and having an upper opening. Since the gap i mentioned above provides a space in which the face portion 2*a* can bend sufficiently to a rear side of the head, the gap i can improve a head repulsion characteristic.

Further, the head main body 2 is provided with at least two holes 4. In this embodiment, three holes 4 are provided in the turnup wall 2*c*.

The holes 4 include a toe-side hole 4*t* provided in a side closest to a toe T, a heel-side hole 4*h* provided in a side closest to a heel H, and at least one, one in the present embodiment intermediate hole 4*c* provided therebetween. Each axial center line of each of the hole portions 4 is approximately perpendicular to the turnup wall 2*c*, and is approximately in parallel to the horizontal plane HP, as shown in FIG. 4 or FIG. 5. Further, each of the holes 4 is formed as a through hole passing through the turnup wall 2*c* back and forth. In this case, it may be constituted by a hole having an opening only in an outer surface of the turnup wall 2*c*.

In the present embodiment, each detachable part 3 includes a head part 3A, and a screw part 3B having a smaller outer diameter than the head part 3A and provided with an external thread in an outer surface. In order to install the detachable part 3 to the holes of the head main body 2 detachably, each hole 4 includes a main hole part 4A accommodating the head part 3A of the detachable part 3, and an internal thread 4B extending from the main hole part 4A and engaging with the screw part 3B.

Accordingly, each of the detachable parts 3 can be firmly fixed to the hole 4 by engaging the screw part 3B with internal thread 4B of the hole 4 from an outer side of the head main body 2. At this time, the head part 3B of the detachable part 3 is accommodated in the main hole part 4A of the hole 4 without protruding from the outer surface of the turnup wall 2*c*. Further, since the head part 3A is closely contacted with the main hole portion 4A, it is possible to firmly position the detachable part 3 in an axial direction.

Further, in the present embodiment, each detachable part 3 can be attached to any holes 4, and can be detached therefrom, by making shapes of the detachable parts 3 substantially identical and making shapes of the holes 4 substantially identical. However, a length of the screw part 3B of the detachable parts 3 and/or the internal thread 4B of the holes 4 may be allowed to appropriately change.

In the present embodiment, the head part 3A of the detachable part 3 is formed in a disk shape. Further, the main hole part 4A is formed by a circular hole in such a manner as to coincide with the head part 3A. Further, the head part 3A is provided with tool insertions hole 6 for rotating the detachable part 3 by a tool. Since the head part 3A is visible from an outer portion, the tool insertion hole 6 is provided with, for example, a plurality of (five in the present embodiment) concave portions 5 uniformly and intermittently formed in a circumferential direction in place of a plus screw or a minus screw, on a surface thereof. The tool insertion hole 6 mentioned above serves for improving a design. Further, the replaceable parts 3 can be fastened to the holes 4 or detached from the holes 4 by using a special tool TL having convex portions 7 corresponding to the concave portions 5. Accordingly, it is possible to easily install, detach and replace the parts 3, for example, by a golfer buying this club.

Further, the detachable parts 3 include a weight member 3*a* made of a material having a greater specific gravity than the head main body 2, and a damper 3*b* having a different specific gravity from the weight member 3*a* and including an elastic material absorbing a vibration of the head main body 2 at least in a part thereof. The detachable parts 3 in accordance with the present embodiment are constituted totally by three elements comprising one weight member 3*a* and two dampers 3*b*. Accordingly, these parts 3 are attached to all the holes 4.

In the club head 1 mentioned above, a center of gravity of the club head 1 is adjusted in correspondence to a play style or a skill of each golfer by changing the position of the hole 4 to which the weight member 3*a* is attached. Further, since the damper 3*b* can absorb the vibration of the head main body at a time of hitting the ball, it is possible to reduce the vibration transmitted to a hand of the player and it is possible to provide an improved ball hitting feeling.

Figure 11B:
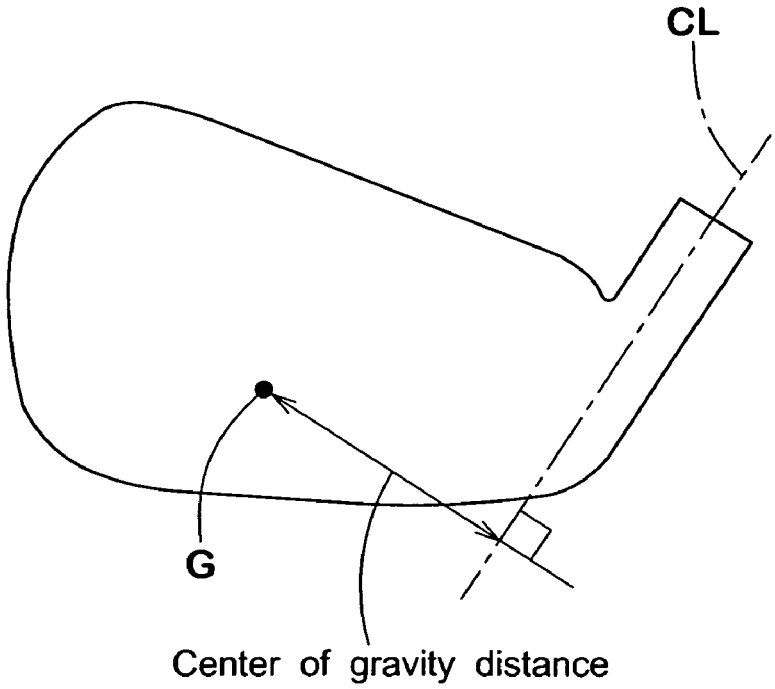
FIG. 11(B) is a front elevational view of FIG. 11(A).

For example, in the case that the weight member 3*a* is installed to the toe-side hole 4*t*, the center of gravity of the club head 1 is close to the toe side. Accordingly, it is possible to provide a club head having a great center of gravity distance. In this case, the "center of gravity distance" corresponds to the shortest distance from a shaft center line CL of the shaft insertion hole of the hosel portion 2*d* to the center of gravity G of the club head, as shown in FIG. 11(B). The club head 1 mentioned above is hard to be returned to an address state at a time of swinging, the hit ball tends to slice (is hard to hook). Accordingly, the club head 1 mentioned above is suitable for the golfer who is worried about the hook ball.

On the contrary, since the center of gravity of the club head 1 comes close to the heel side by installing the weight member 3*a* to the heel-side hole 4*h*, it is possible to provide a club head having a small center of gravity distance. Since the club head 1 mentioned above tends to be returned to the address state at a time of swinging, the hit ball tends to hook (is hard to slice). Accordingly, the club head 1 mentioned above is suitable for the golfer who is worried about the slice ball.

Further, in the case that the weight member 3*a* is installed to the intermediate hole 4*c*, the center of gravity of the club head is biased to a center and a rear side in the toe and heel direction. In the club head 1 mentioned above, the center of gravity depth becomes larger, and the sweet area is enlarged. Accordingly, it is possible to provide a club in which the direction stability is improved even if the ball hitting points on the face are dispersed. In this case, the "center of gravity depth" is a distance from the center of gravity G of the club head to the sweet spot S along the normal line N, as shown in FIG. 11(A).

The specific gravity ρ1 of the weight member 3*a* is not particularly limited as far as it is larger than the specific gravity ρm of the head main body 2, however, it is preferably not less than 5.0, and more preferably not less than 7.0. In the case that the specific gravity ρ1 is less than 5.0, a great volume may be necessary for sufficiently securing an adjusting margin of the center of gravity of the club head. Further, an upper limit of the specific gravity ρ1 is not particularly limited, however, if it is too large, the center of gravity is significantly changed, and the cost becomes high. Accordingly, the upper limit is preferably not more than 22.0, more preferably not more than 21.0, and further preferably not more than 20.0.

Further, if a difference (ρ1−ρm) between the specific gravity ρ1 of the weight member 3*a* and the specific gravity ρm of the head main body 2 is too small, it is hard to move the center of gravity of the club head. On the other hand, if the difference (ρ1−ρm) is too large, the center of gravity position may be moved to an improper position depending upon the arranged position of the weight member 3*a*. From this point of view, it is desirable that the difference (ρ1 −ρm) of the specific gravities is preferably not less than 3.0, more preferably not less than 4.0, and further preferably not less than 5.0, and an upper limit thereof is preferably not more than 12.0, more preferably not more than 11.0, and further preferably not more than 10.0.

As a specific material of the weight member 3*a*, for example, a copper (specific gravity 8.9), a copper alloy, a tungsten (specific gravity 19.1), a tungsten nickel (specific gravity 14.0), a stainless steel (specific gravity 7.8), a nickel alloy, a brass or a lead is used, and it is possible to use by combining one or two or more of them. In this case, typical specific gravity values are shown above.

Further, as shown in FIG. 4, it is desirable that a height hg from the horizontal plane HP to the center of gravity G1 of the weight member 3*a* under the standard condition is preferably not more than 20.0 mm, more preferably not more than 18.0 mm, and further preferably not more than 15.0 mm. Accordingly, it is possible to prevent the center of gravity of the club head 1 from becoming higher. On the other hand, if the height hg is too small, there is a risk that the weight of the weight member 3*a* becomes smaller on the basis of the compact structure of the weight member 3*a*. From this point of view, the height hg is preferably not less than 4.0 mm, more preferably not less than 5.0 mm, and further preferably not less than 6.0 mm.

The damper 3*b* is installed to the head main body 2 by being inserted to the hole 4 from the turnup wall 2*c* toward the gap i and being screwed. In accordance with the screw fastening, the screw part 3B of the damper 3*b* is closely-engaged with the internal thread 4B, and is brought into contact with the head main body 2 in a state of being exposed to a stress. Accordingly, the vibration of the head main body 2 generated at a time of hitting the ball is efficiently transmitted to the damper 3*b* via the hole 4. Further, the damper 3*b* converts the vibration transmitted from the head main body 2 into a thermal energy on the basis of its own internal friction or the like, and damps the vibration of the club head 1 in an early stage by extension. Accordingly, the club head 1 in accordance with the present embodiment provided an improved ball hitting feeling.

As for damper 3*b*, a non-metal material, for example, a vulcanized rubber (specific gravity 1.3), an elastomer (specific gravity 1.2), a resin (specific gravity about 1.1) and the like is preferably used. Above all, in order to make the vibration or impact absorbing characteristic high and apply a sufficient strength to the external thread or the like, a thermoplastic elastomer having a soft segment and a hard segment is desirable for an elastic material of the damper. In this case, the typical value of the specific gravity is shown above.

As the thermoplastic elastomer mentioned above, the following elastomer is desirable:

a styrene thermoplastic elastomer including a polystyrene as the hard segment, and a polybutadiene or a polyisoprene as the soft segment;

an urethane thermoplastic elastomer (TPU) including a polyurethane as the hard segment, and a polyester or an ether as the soft segment;

an ester thermoplastic elastomer (TPEE) including a polyester as the hard segment, and a polyether or an ester as the soft segment; or an amide thermoplastic elastomer (TPA) including a nylon 12 as the hard segment, and a plasticizer or a polyether as the soft segment.

The thermoplastic polyurethane elastomer is particularly desirable in the light of the productivity.

Figure 6A:
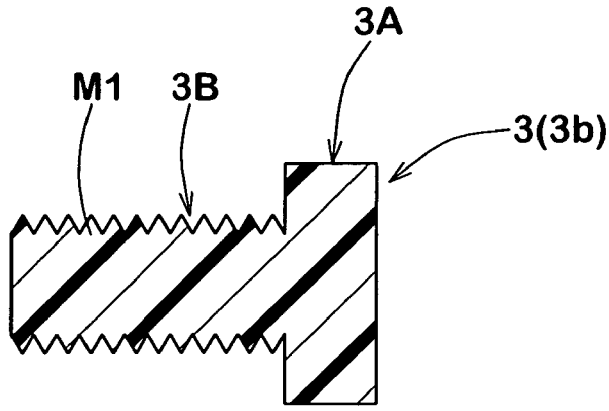
FIGS. 6(A) to 6(C) are cross sectional views showing an embodiment of a damper.
Figure 6B:
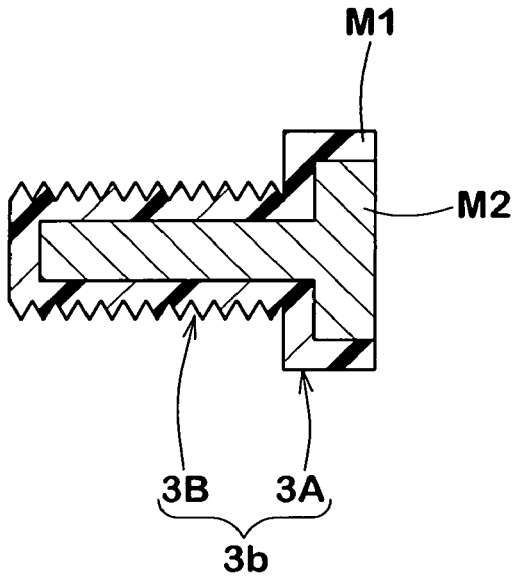

It is desirable that an entire of the damper 3*b* is structured by an elastic material M1, for example, as shown by FIG. 6(A), however, the damper 3*b* may be structured, for example, as shown by FIG. 6(B), such that an outer portion brought into contact with the head main body 2 is formed by the elastic material M1, and a core material made of a metal material M2 for increasing a strength is arranged in an inner portion thereof. In accordance with this aspect, it is possible to further increase a durability of the damper 3*b*. In this case, if the elastic material M1 has a sufficient strength, the damper 3*b* may be formed as a hollow shape (not shown).

The specific gravity ρ2 of the damper 3*b* is different from the specific gravity ρ1 of the weight member 3*a*, however, if it is too large, an increase of the weight of the head main body 2 is caused. Therefore, the specific gravity ρ2 of the damper 3*b* is smaller than the specific gravity ρ1 of the weight member 3*a*. On the other hand, if the specific gravity ρ2 of the damper 3*b* is too small, the rigidity is lowered and the damper may be broken due to the impact at a time of hitting the ball. From this point of view, the specific gravity ρ2 of the damper 3*b* is preferably not less than 0.5, more preferably not less than 0.7, and further preferably not less than 0.9, and an upper limit thereof is preferably not more than 2.2, more preferably not more than 2.0, and further preferably not more than 1.8.

Further, if the difference (ρ1−ρ2) between the specific gravity ρ1 of the weight-member 3*a* and the specific gravity ρ2 of the damper 3*b* is too small, there is a tendency that an adjustment amount of the center of gravity of the club head 1 becomes smaller in the case of replacing the installing positions thereof. On the contrary, if the difference (ρ1−ρ2) is too large, there is a tendency that the center of gravity is significantly changed and it is moved to an improper position, on the basis of the position replacement between the weight member 3*a* and the damper 3*b*. From this point of view, the difference (ρ1−ρ2) of the specific gravities mentioned above is preferably not less than 3.0, more preferably not less than 4.0, and further preferably not less than 5.0, and it is desirable that an upper limit thereof is preferably not more than 20.0, more preferably not more than 19.0, and further preferably not more than 18.0.

Further, as shown in FIG. 5, in the standard condition, the height hg of the damper 3*b* from the horizontal plane HP to the center of gravity G2 thereof is preferably not more than 20.0 mm, more preferably not more than 18.0 mm, and further preferably not more than 15.0 mm, in the same manner as the weight member 3*a*, and it is desirable that it is preferably not less than 4.0 mm, more preferably not less than 5.0 mm, and further preferably not less than 6.0 mm.

Further, as shown in FIG. 4 or 5, both of the weight member 3*a* and the damper 3*b* have a protruding portion 7 protruding into the gap i from the hole 4. Particularly, it is desirable to make the protruding portion 7 execute a free vibration by setting the protruding portion 7 of the damper 3*b* to a cantilever condition. In other words, it is desirable that the protruding portion 7 of the damper 3*b* is provided in such a manner as to be prevented from being in contact with the back surface of the face portion 2*a* in both of the stationary state and the ball hitting state. Accordingly, the protruding portion 7 freely vibrates at a time of hitting the ball, and can further increase a vibration damping effect.

In order to keep the damping effect sufficiently without breaking due to the impact at a time of hitting the ball, an axial length L of the protruding portion 7 is preferably not less than 2.0 mm, more preferably not less than 2.5 mm, and further preferably not less than 3.0 mm, and is preferably not more than 10.0 mm, more preferably not more than 9.0 mm, and further preferably not more than 8.0 mm.

Figure 6C:
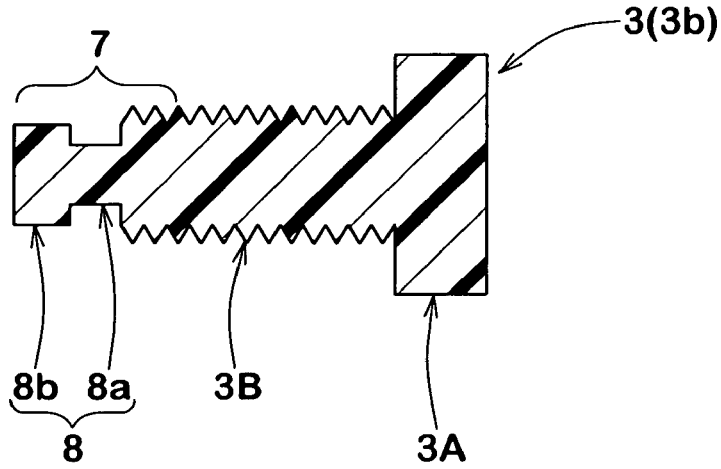

For example, the damper 3*b* can be provided with a vibrator 8 including a large-diameter portion 8*b* having a great outer diameter and a small-diameter axis 8*a* connecting between the large-diameter portion 8*a* and the screw part 3B and having a small outer diameter, as shown in FIG. 6(C). Since the large-diameter portion 8*b* can be greatly vibrated, the vibrator 8 mentioned above can further increase the vibration damping effect. In this case, the outer diameter of the large-diameter portion 8*b* is smaller than a ridge diameter of the screw part 3B.

Figure 7:
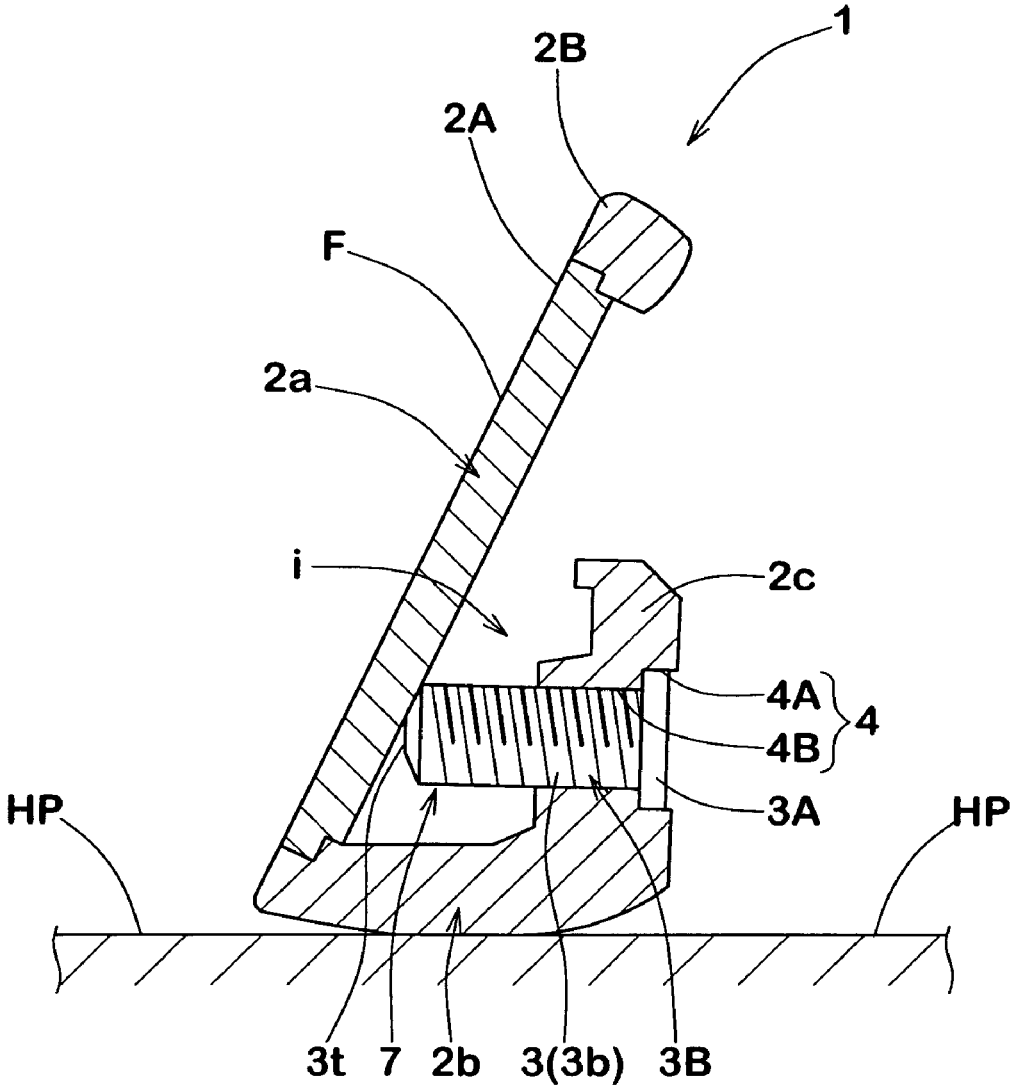
FIG. 7 is a cross sectional view along a line B-B in FIG. 3 showing the other embodiment.

Further, as shown in FIG. 7, the leading end 3*t* of the protruding portion 7 may be brought into contact with the back surface of the face portion 2*a* so as to directly absorb the vibration of the face portion 2*a*.

Further, since the weight member 3*a* does not substantially take part in the vibration damping, the weight member 3*a* may be provided with no protruding portion 7.

In order to achieve a secure fixation between the detachable part 3 and the hole 4, a length "m" of the internal thread 4B in an axial direction is preferably not less than 3.0 mm, more preferably not less than 3.5 mm, and further preferably not less than 4.0 mm. In the case that the length m is less than 3.0 mm, the bonding strength between the hole 4 and the detachable part 3 may be lowered. On the other hand, the detachable part 3 has a limitation in its length. Therefore, if the length m is too large, it is hard to form the protruding portion 7 executing the free vibration mentioned above. From this point of view, the length m is preferably not more than 15.0 mm, more preferably not more than 14.0 mm, and further preferably not more than 13.0 mm.

Further, in order to achieve a secure fixation between the detachable part 3 and the hole 4, the height of the screw ridge is not less than 0.20 mm, more preferably not less than 0.25 mm, and further preferably not less than 0.30 mm, and an upper limit thereof is preferably not more than 1.50 mm, more preferably not more than 1.30 mm, and further preferably not more than 1.10 mm. The height of the screw ridge is obtained by an expression {(outer diameter−root diameter)/2} in the screw part 3B, and is obtained by an expression {(root diameter−inner diameter)/2} in the internal thread 4B.

Figure 8:
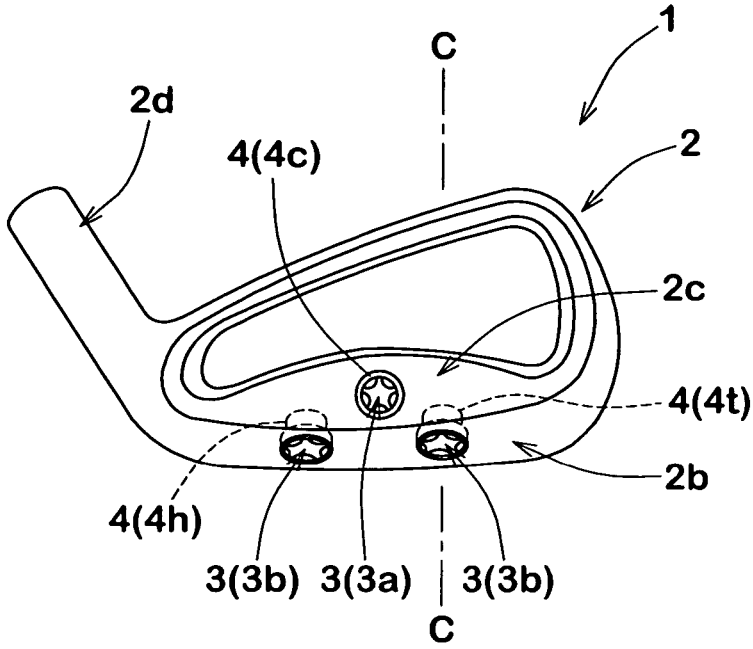
FIG. 8 is a back elevational view of a club head showing the other embodiment in accordance with the present invention.
Figure 9:
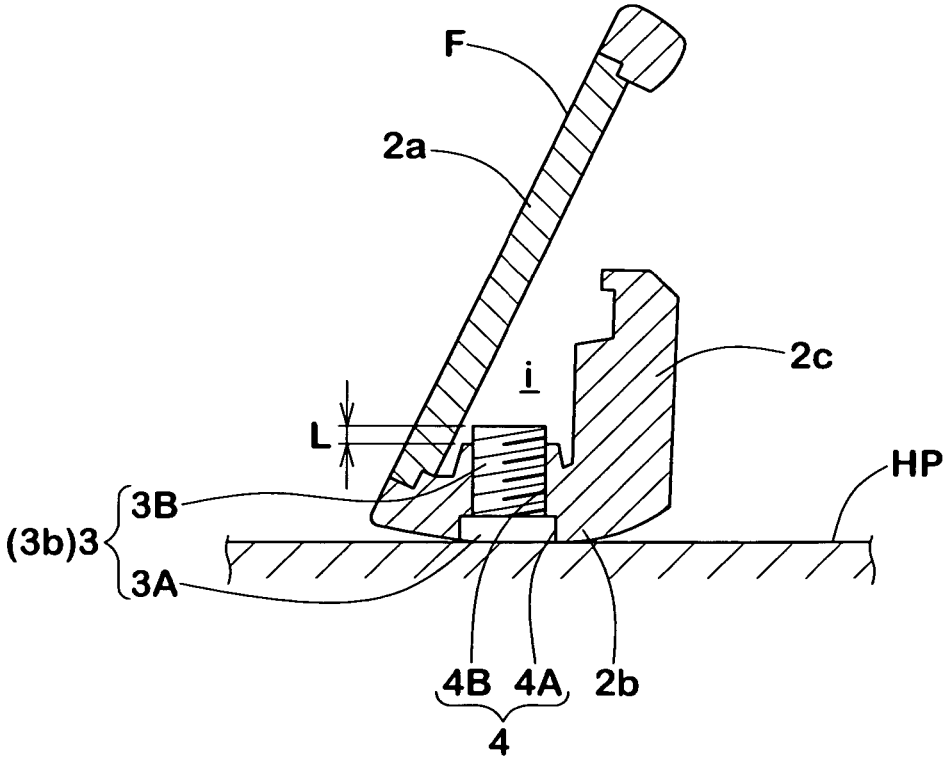
FIG. 9 is a cross sectional view along a line C-C in FIG. 8.

FIGS. 8 and 9 show the other embodiment in accordance with the present invention. FIG. 9 is a cross sectional view along a line C-C in FIG. 8, and FIG. 8 shows the same condition as FIG. 3. In this embodiment, the detachable parts 3 are installed to the sole portion 2*b* and the turnup wall 2*c*. For example, the toe-side hole 4*t* and the heel-side hole 4*h* are provided in the sole portion 2*b*, and the intermediate hole 4*c* is provided in the turnup wall 2*c*. In this case, the installed position of the detachable part 3 can be optionally determined.

As a preferable embodiment, the weight member 3*a* is installed to the intermediate hole 4*c*, and the dampers are installed to the toe-side hole 4*t* and/or the heel-side hole 4*h*. In general, since the sole portion 2*b* has a chance of being in contact with the ground at a time of hitting the ball, the greater impact force tends to be generated. Accordingly, the vibration at a time of hitting the ball can be effectively reduced by installing the damper(s) 3*b* to the sole portion 2*b* mentioned above.

The damper 3*b* is inserted toward the gap i from the outer surface of the sole portion 2*b* so as to be screwed. Accordingly, the head part 3A is accommodated in such a manner as to be approximately flush with the outer surface of the sole portion 2*b* without protruding from the main hole portion 4A of each of the holes 4*h* and 4*t*. Therefore, even in the case that the sole portion 2*b* is in contact with the ground surface, there is not generated a risk that the head part 3A of the damper 3*b* is interfered with the ground so as to prevent the swing. Further, the screw part 3B of the damper 3*b* includes the protruding portion 7 protruding into the gap i from the holes 4*t* and 4*h*.

In this case, in the embodiment mentioned above, the installed position of the weight member 3*a* and the damper 3*b* can be appropriately selected at a favorite position in correspondence to each golfer using the club head 1.

Figure 10A:
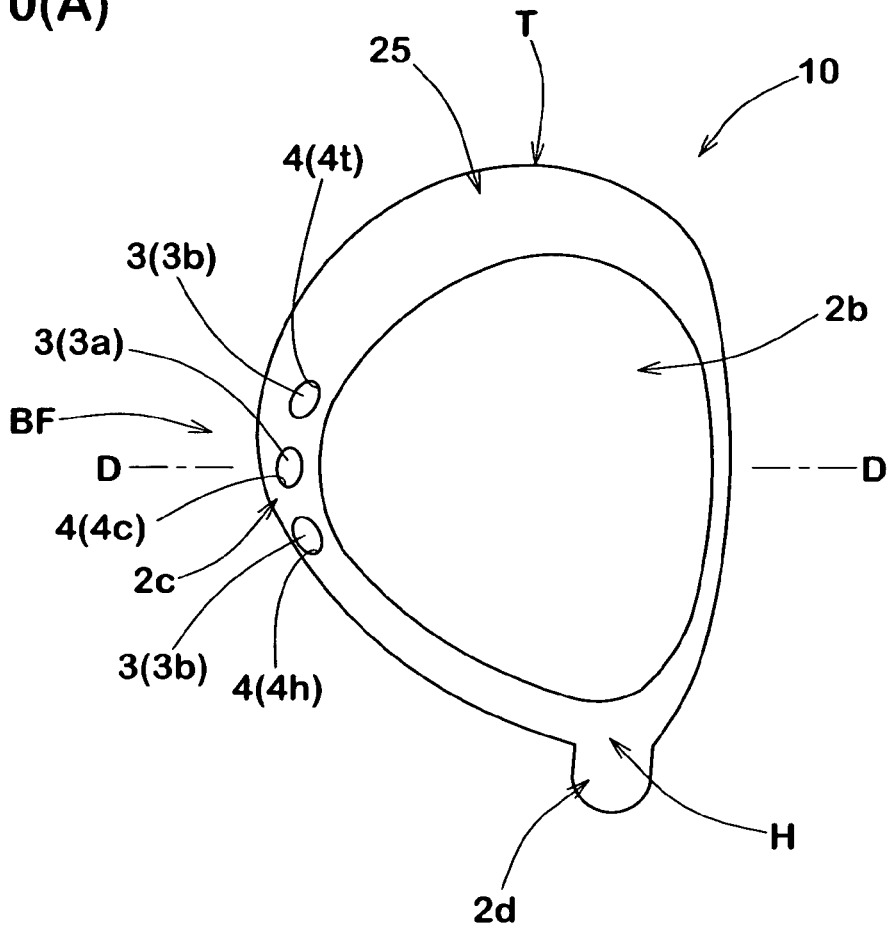
FIG. 10(A) is a bottom view of a wood type club head showing the other embodiment.
Figure 10B:
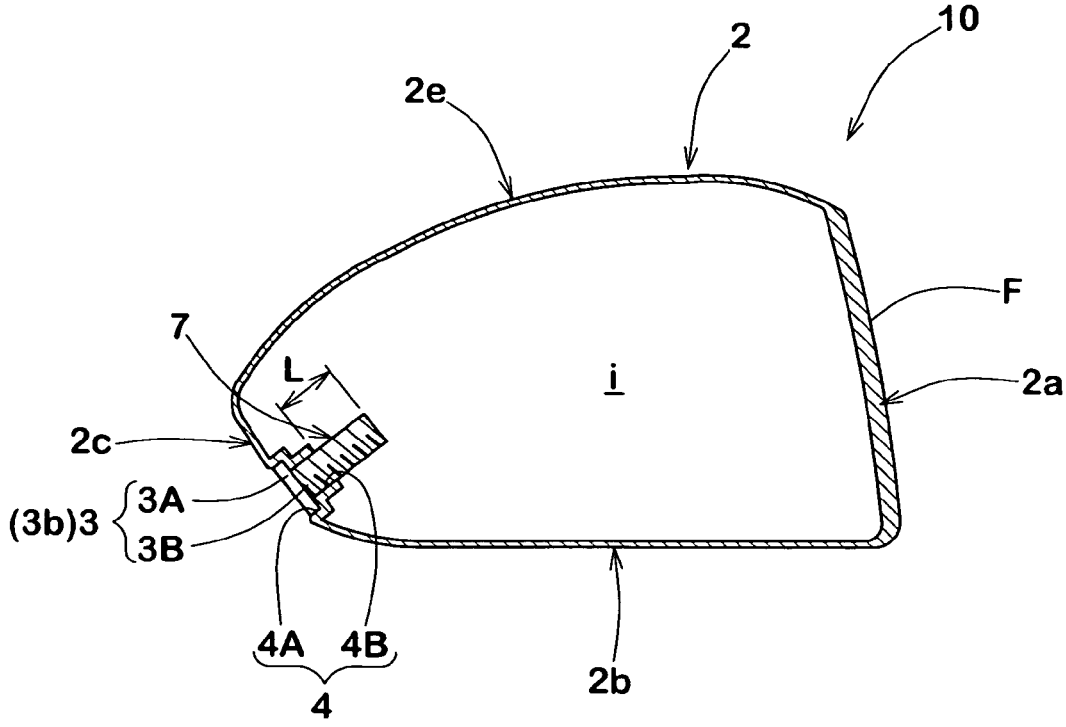
FIG. 10(B) is a cross sectional view along a line D-D in FIG. 10(A)

Further, the present invention may be executed as a wood type golf club head 10, as shown in FIGS. 10(A) and 10(B).

The wood type golf club head 10 comprises a face portion 2*a* having a club face F, a crown portion 2*e* connected to an upper edge of the club face F and forming a head upper surface, a sole portion 2*b* connected to a lower edge of the club face F and forming a head bottom surface, a side portion 2*f* having a turnback wall 2*c* forming a gap i with respect to the face portion 2*a* by extending upward so as to be away from the face portion 2*a* in a rear end of the sole portion 2*b*, and a hosel portion 2*d*. In this case, the gap i is formed as a substantially closed hollow portion.

The club head 10 is provided with three holes 4 in the turnup wall 2*c*. In more detail, the hole 4 includes a toe-side hole 4*t*, a heel-side hole 4*h* and an intermediate hole 4*c* therebetween. Further, three detachable parts 3 which includes at least one weight member 3*a* and at least one damper 3*b* are installed to the hole 4 toward the gap i from a head outer side. Further, an axial direction of the weight member 3*a* and the damper 3*b* is approximately perpendicular to the outer surface of the turnup wall 2*c*. In this embodiment, the hole 4 and the detachable part 3 can be firmly attached in accordance with a screw fastening.

The description is given above of the embodiments in accordance with the present invention, however, it goes without saying that the present invention is not limited to the embodiments mentioned above, but can be executed by being modified to various aspects. For example, the club head includes a putter type and utility type. Further, the number of the detachable parts (and the holes) may be set to four or more.

Comparison Test

In order to confirm the effect of the present invention, a number 5 iron club heads with a loft angle of 24 degree were manufactured on the basis of the specification in Table 1. A stainless steel with a specific gravity 7.8 was used in each club head. As to a resin of the damper shown in Table 1, a Thermoplastic polyurethane elastomer with JISA hardness of 91 degrees (Elastoran C type C90A manufactured by BASF Japan Co., Ltd.) was used. Further, there were executed a measurement of the center of gravity position and the like, an actually ball hitting test and a durability test. Further, the same tests were executed in the following references for comparison.

Reference 1:

Two detachable parts made of a magnesium alloy (a non-elastic member) were used instead of two dampers in accordance with the example 1. In this case, the detachable part made of magnesium alloy was formed as a hollow structure in an inner portion, and the center of gravity position and the entire weight were regulated in the same manner as the damper in accordance with the example 1.

Reference 2:

The reference 2 was constituted by a club head having no weight member and no damper. Accordingly, the hole is not provided.

The measuring method and the test method are as follows.

Sweet Spot Height:

As shown in FIG. 11(A), the height from the horizontal plane HP to the sweet spot S was measured in the standard condition.

Ball Hitting Test:

First, the same shaft made of FRP was installed to each of the club heads, and the number 5 iron golf clubs were manufactured. Next, each of ten golfers having handicaps between 5 and 15 hit ten balls on a natural turf by using each of the test clubs, and an evaluation was executed about a hit ball carry, a total distance, a ball hitting angle, a backspin amount, a directional displacement, and a ball hitting feeling. The directional displacement is obtained by measuring right and left displacement amounts with respect to a target direction in ten balls and calculating an average value (in this case, the displacement amount is set to a plus value whichever right or left the ball is displaced so as to be averaged).

Further, the ball hitting feeling is evaluated on the basis of the following standard. An average value is shown in the other test items.

Very Good: number of golfers feeling good is not less than 8

Good: number of golfers feeling good is not less than 5 and less than 7

Bad: number of golfers feeling good is less than 5

Durability Test:

Each of the test clubs was attached to a swing robot and hits 5000 golf balls at a head speed of 38 m/s. After finishing the ball hitting, it was visually observed whether the detachable parts were detached.

Results of the tests are shown in Table 1.

As a result of the tests, it can be confirmed that the club head in accordance with the example has a low sweet spot height, a deep center of gravity depth, and a small center of gravity distance, and is excellent in the carry and the directionality. Further, it can be confirmed that the club head in accordance with the example has an improved ball hitting feeling.

TABLE 1

| | Ref. 1 | Ref. 2 | Ex. 1 | Ex. 2 | Ex. 3 | Ex. 4 | Ex. 5 | Ex. 6 |
|---|---|---|---|---|---|---|---|---|
| Layout of hole | FIG. 1 | — | FIG. 1 | FIG. 1 | FIG. 1 | FIG. 8 | FIG. 1 | FIG. 1 |
| Material of weight member | W—Ni | — | W—Ni | W—Ni | W—Ni | W—Ni | W—Ni | W—Ni |
| Specific gravity p1 of weight member | 14.5 | — | 14.5 | 14.5 | 14.5 | 14.5 | 14.5 | 14.5 |
| Number of weight member | 1 | 0 | 1 | 1 | 1 | 1 | 1 | 1 |
| Weight of weight member [g] | 4.4 | — | 4.4 | 5.6 | 4.4 | 4.4 | 4.4 | 4.4 |
| Installed position of weight member | Intermediate | — | Intermediate | Intermediate | Intermediate | Intermediate | Toe side | Heel side |
| Material of damper | — | — | Resin | Resin | Resin | Resin | Resin | Resin |
| Specific gravity p2 of damper | — | — | 1.2 | 1.2 | 1.2 | 1.2 | 1.2 | 1.2 |
| Number of damper | 0 | 0 | 2 | 2 | 2 | 2 | 2 | 2 |
| Weight of damper (per one) [g] | 0 | — | 0.4 | 0.5 | 0.4 | 0.4 | 0.4 | 0.4 |
| Height hg [mm] | 10 | — | 10 | 10 | 18 | 10 | 10 | 10 |
| Length of protruding portion of damper [mm] | — | — | 0 | 3 | 0 | 0 | 0 | 0 |
| Sweet spot height [mm] | 19.5 | 21.2 | 19.5 | 19.5 | 20.1 | 19.6 | 19.5 | 19.5 |
| Center of gravity depth [mm] | 5.4 | 5.9 | 5.4 | 5.5 | 5.7 | 5.4 | 5.5 | 5.5 |
| Center of gravity distance [mm] | 41.0 | 41.3 | 40.1 | 40.3 | 40.6 | 40.1 | 41.5 | 39.3 |
| Carry [yard] | 170.4 | 165.1 | 170.5 | 170.8 | 168.7 | 170.6 | 170.5 | 170.6 |
| Total distance [yard] | 174.8 | 167 | 174.8 | 175.0 | 172.1 | 174.7 | 174.6 | 174.8 |
| Ball hitting angle [deg] | 14.4 | 13.2 | 14.5 | 14.6 | 13.9 | 14.5 | 14.4 | 14.5 |
| Backspin amount [rpm] | 3760 | 4043 | 3755 | 3720 | 3840 | 3750 | 3745 | 3772 |
| Directional displacement [yard] | 10.2 | 9.9 | 10.2 | 9.8 | 10.0 | 10.3 | 10.5 | 10.3 |

TABLE 1-continued

| | Ref. 1 | Ref. 2 | Ex. 1 | Ex. 2 | Ex. 3 | Ex. 4 | Ex. 5 | Ex. 6 |
|---|---|---|---|---|---|---|---|---|
| Ball hitting feeling | Bad | Bad | Very good | Very good | Very good | Better | Very good | Very good |
| Durability | No detachment | No detachment | No detachment | No detachment | No detachment | No detachment | No detach-ment | No detach-ment |

The invention claimed is:

1. A golf club head comprising a main body provided with at least two holes separately and detachable parts attached to said holes, the main body comprising a face portion whose front face defines a club face for hitting a ball, a sole portion extending from a lower edge of the club face toward a back face of the club head and a turnup wall turned up at a rear side of the sole portion so as to form a gap behind the face portion, the holes being provided in the sole portion and/or the turnup wall, and being through holes passing through the sole portion and/or the turnup wall, and the detachable parts including a weight member attached to one of the holes and a damper attached to another of the holes, the weight member having a specific gravity larger than the specific gravity of the main body, the damper having a specific gravity different from the specific gravity of the weight member and made of elastic material at least partially for absorbing a vibration of the main body, and the damper having a protruding portion extending from the hole into the gap, and said holes having the substantially identical shapes so that the position of each of the detachable parts can be exchanged.

2. The golf club head according to claim 1, wherein in a standard condition where the golf club head is placed on a horizontal plane at its lie and loft angles, each center of gravity of the weight member and the damper is within 15.0 mm from the horizontal plane.

3. The golf club head according to claim 1, wherein the weight member and the damper each comprise a screw part having an external thread, and each hole of the main body comprises an internal thread engaging with the external thread.

4. The golf club head according to claim 1, wherein the detachable parts comprises two dampers, the holes comprise a toe-side hole, a heel-side hole and a middle hole therebetween, the weight member is attached to the middle hole, and a damper is attached to each of the toe-side hole and the heel-side hole.

5. The golf club head according to claim 1, wherein the specific gravity of the weight member is from 5.0 to 22.0, and the specific gravity of the damper is from 0.5 to 2.2.

6. The golf club head according to claim 1, wherein the holes are provided in the turnup wall.

7. The golf club head according to claim 6, wherein the holes are through holes passing through the turnup wall, and the damper has a protruding portion extending from the hole into the gap.

8. The golf club head according to claim 7, wherein an axial length of the protruding portion is in a range of from 2.0 to 10.0 mm.

9. The golf club head according to claim 7, wherein an end of the protruding portion comes in contact with the back surface of the face portion.

10. The golf club head according to claim 1, wherein the protruding portion has a length in a range of from 2.0 to 10.0 mm.

11. The golf club head according to claim 1, wherein an end of the protruding portion comes in contact with the back surface of the face portion.

12. A golf club head comprising a main body provided with at least two holes and detachable parts attached to said holes, the detachable parts including a weight member and a damper, the weight member having a specific gravity larger than the specific gravity of the main body, the damper having a specific gravity different from the specific gravity of the weight member and made of elastic material at least partially for absorbing a vibration of the main body, and the damper and the weight member being attached to the holes of the main body so that the position of each of the weight member and the damper can be exchanged, wherein in a standard condition where the golf club head is placed on a horizontal plane at its lie and loft angles, each center of gravity of the weight member and the damper is within 15.0 mm from the horizontal plane.

13. The golf club head according to claim 12, wherein each weight member and the damper comprises a screw part having a external thread, and each hole of the main body comprises an internal thread engaging with the external thread.

14. The golf club head according to claim 12, wherein the main body comprises a face portion whose front face defines a club face for hitting a ball, a sole portion extending from a lower edge of the club face toward a back face of the club head and a turnup wall turned up at a rear side of the sole portion so as to form a gap behind the face portion, and the holes are provided in the sole portion and/or the turnup wall.

15. A golf club head comprising a main body provided with at least two holes separately and detachable parts attached to said holes, the main body comprising a face portion whose front face defines a club face for hitting a ball, a sole portion extending from a lower edge of the club face toward a back face of the club head and a turnup wall turned up at a rear side of the sole portion so as to form a gap behind the face portion, the holes provided in the sole portion and/or the turnup wall, and comprising a toe-side hole, a heel-side hole and a middle hole therebetween, the detachable parts including a weight member and two dampers, the weight member having a specific gravity larger than the specific gravity of the main body and attached to the middle hole, each damper having a specific gravity different from the specific gravity of the weight member and made of elastic material at least partially for absorbing a vibration of the main body and attached to the each of the toe-side hole and the heel side hole, and said holes having the substantially identical shapes so that the position of each of the detachable parts can be exchanged.

16. The golf club head according to claim 15, wherein each weight member and the damper comprises a screw part having a external thread, and each hole of the main body comprises an internal thread engaging with the external thread.

* * * * *